US009033179B2

(12) United States Patent
Allen et al.

(10) Patent No.: US 9,033,179 B2
(45) Date of Patent: May 19, 2015

(54) WATER TANK

(71) Applicant: Vicwest Corporation, Oakville (CA)

(72) Inventors: Bruce Allen, Selkirk (CA); Yuqin Shan, Winnipeg (CA); Nhi Y Le, Winnipeg (CA)

(73) Assignee: Vicwest Inc, Oakville, ON (CA)

( * ) Notice: Subject to any disclaimer, the term of this patent is extended or adjusted under 35 U.S.C. 154(b) by 150 days.

(21) Appl. No.: 13/682,170

(22) Filed: Nov. 20, 2012

(65) Prior Publication Data

US 2014/0138389 A1 May 22, 2014

(51) Int. Cl.

| | |
|---|---|
| ***B65D 90/00*** | (2006.01) |
| ***B65D 90/08*** | (2006.01) |
| ***B65D 90/10*** | (2006.01) |
| ***B65D 90/20*** | (2006.01) |

(52) U.S. Cl.

CPC ..... *B65D 90/08* (2013.01); *B65D 90/10* (2013.01); *B65D 90/205* (2013.01)

(58) Field of Classification Search

CPC .... B65D 90/02; B65D 90/027; B65D 90/028; B65D 90/04; B65D 90/044; B65D 90/08; B65D 90/10; B65D 90/205

USPC ..... 220/565, 561, 562, 567, 681, 4.13

See application file for complete search history.

(56) References Cited

U.S. PATENT DOCUMENTS

| | | | | | |
|---|---|---|---|---|---|
| 1,076,382 | A * | 10/1913 | Maloney | 220/4.17 |
| 1,265,966 | A * | 5/1918 | Schlafly | 52/245 |
| 1,765,946 | A * | 6/1930 | Shea | 220/565 |
| 1,875,666 | A * | 9/1932 | Schwemlein | 220/693 |
| 2,750,013 | A * | 6/1956 | Johnson et al. | 52/193 |
| 2,914,149 | A * | 11/1959 | Walker | 52/394 |
| 3,233,251 | A * | 2/1966 | Barrera | 52/245 |
| 3,562,822 | A * | 2/1971 | Wall | 52/245 |
| 3,631,545 | A * | 1/1972 | Orndorff | 52/169.7 |
| 3,793,651 | A * | 2/1974 | Pitti et al. | 52/169.7 |
| 4,036,390 | A * | 7/1977 | Morse | 220/562 |
| 4,240,562 | A * | 12/1980 | Holschlag | 220/565 |
| 4,591,067 | A * | 5/1986 | Byers | 220/681 |
| 4,603,525 | A * | 8/1986 | Byers et al. | 52/245 |
| 5,029,426 | A * | 7/1991 | Larson et al. | 52/745.01 |
| 6,199,712 | B1 * | 3/2001 | Rosset | 220/495.01 |
| 6,715,243 | B1 * | 4/2004 | Fons | 52/192 |
| 6,739,469 | B1 * | 5/2004 | Kim | 220/4.12 |
| 8,316,615 | B2 * | 11/2012 | Haridasu et al. | 52/745.17 |
| 8,365,937 | B2 * | 2/2013 | Lovelace et al. | 220/4.17 |
| 8,397,366 | B2 * | 3/2013 | Gotz et al. | 29/428 |
| 8,534,480 | B1 * | 9/2013 | Hanna | 220/4.17 |
| 2007/0023438 | A1 * | 2/2007 | Kenneth | 220/495.04 |
| 2009/0114655 | A1 * | 5/2009 | Weatherstone et al. | 220/495.05 |
| 2009/0242577 | A1 * | 10/2009 | Dingeldein et al. | 220/650 |

(Continued)

*Primary Examiner* — Anthony Stashick
*Assistant Examiner* — Ernesto Grano
(74) *Attorney, Agent, or Firm* — Adrian D. Battison; Ade & Company Inc

(57) ABSTRACT

A cylindrical upstanding water tank is formed from a plurality of rows of corrugated curved panels bolted edge to edge with a liner extending over the cylindrical wall and support surface to contain the water within the tank. An access opening is formed in one panel of the cylindrical wall and includes a frame with a rectangular planar front flange and a rearwardly extending flange welded into the hole. Liner retention straps surround the hole to fasten an edge of the liner around the hole. An access cover plate is bolted to the front flange of the frame and carries a hoop strength plate which fastens to studs at the rear of the plane so that the plates are removable to allow service access to the interior of the tank.

11 Claims, 7 Drawing Sheets

(56) References Cited

U.S. PATENT DOCUMENTS

2009/0272049 A1* 11/2009 Johnson et al. ..... 52/192
2011/0272303 A1* 11/2011 Peterken ..... 206/223
2011/0308473 A1* 12/2011 Buchanan ..... 119/226
2013/0031854 A1* 2/2013 Johnson et al. ..... 52/192
2013/0319552 A1* 12/2013 Svarczkopf et al. ..... 137/565.01

* cited by examiner

WATER TANK

This invention relates to a water tank with an access opening which can be entered from a position at or adjacent ground level to allow service operation within the tank without the necessity for climbing.

BACKGROUND OF THE INVENTION

Conventional water tanks are available which include a plurality of rows of curved panels where the panels of each row are connected end edge to end edge to form a cylindrical wall portion and where the wall portions formed by the rows are stacked and connected top edge to bottom edge to form a cylindrical wall extending from a bottom edge of the cylindrical wall mounted on a support surface to a top edge of the wall for containing water. A liner is placed over the cylindrical wall and support surface to contain the water within the tank.

Such tanks can range from relatively small scale tanks of only 6 feet in diameter and 20 feet high to much larger tanks such as 40 feet in diameter and 40 feet high.

In some cases a roof is provided and in some cases the top of the tank is merely open.

On many occasions it is necessary to access the interior of the tank for service of the liner or more typically of seals at wall penetrations where relative movement can cause breakdown in the seal and water loss.

Up to now, it has been considered highly undesirable to breach the wall and/or the liner to allow access at ground level and instead the service personnel must climb over the top edge of the wall to gain access to the interior. In all cases this requires specialized equipment. In smaller tanks this is relatively straightforward but in larger tanks the heights involved can lead to unsafe conditions or the necessity for fall restraint equipment.

SUMMARY OF THE INVENTION

It is one object of the invention to provide a tank of this type with a ground level access.

According to one aspect of the invention there is provided water tank comprising:

a plurality of rows of curved panels where the panels of each row are connected end edge to end edge to form a cylindrical wall portion and where the wall portions formed by the rows are stacked and connected top edge to bottom edge to form a cylindrical wall extending from a bottom edge of the cylindrical wall mounted on a support surface to a top edge of the wall for containing water;

a liner extending over the cylindrical wall and support surface to contain the water within the tank;

and an access opening in the cylindrical wall comprising:

- a frame welded into a hole formed in one of the curved panels;
- a liner retention system surrounding the hole to fasten an edge of the liner around the hole;
- and an access cover plate arranged to be fastened to the frame so as to be removable therefrom to allow access to the interior of the tank inside the liner by a person for service within the interior.

In most cases the tanks are of the type where the wall portions are corrugated with horizontally extending corrugations and the wall portions are bolted together at overlapping edge strips.

Preferably the frame is rectangular with two upstanding side posts and two horizontal connecting rails. However circular or oval frames can be used.

Preferably the frame includes a front planar flange onto which the access cover plate is fastened and a rearwardly extending flange which is welded to the panel at an edge of the hole. That is the front flange is made planar despite the curvature of the panel in the tank wall and attaches to a planar cover panel.

Preferably the rearwardly extending flange of each of the connecting rails is deep enough in a direction into the hole such that a horizontal curved edge of the panel is welded onto the flange across its full width while being spaced from the front flange across its full width. This spacing which becomes narrower at the center and wider at the sides allows the bolts to the cover to be inserted through the flange and also allows access for welding of the flange to the wall.

In order to provide sufficient strength in the connection between the wall panel and the frame, the curved edge of the panel is preferably welded on the inside surface and on the outside surface to the flange.

That is, preferably, the frame includes a front flange onto which the access cover plate is fastened and a rearwardly extending flange which is welded to the panel at an edge of the hole.

Preferably there is provided a hoop strength coupling plate extending across the hole at the frame for transferring hoop loads from the panel across the frame, with the hoop strength coupling plate being removable to allow the access through the frame.

Preferably there is provided a rear flange at each side of the frame extending inwardly across the hole and the hoop strength coupling plate is connected to each of the rear flanges for transferring the hoop loads therebetween.

Preferably the hoop strength coupling plate is removable with the cover plate. However it can be separate and removed separately as a second step in the access process.

In the preferred arrangement, the hoop strength coupling plate is carried on the cover plate for removal therewith since this provides the simplest operation for the service person and a simple relatively inexpensive construction.

Water escape through the opening is preferably provided by a sealing strip located between the cover plate and the frame. In this case, preferably the hoop strength coupling plate is not sealed to the frame so that water enters between the hoop strength coupling plate and the cover plate. An opening to allow the rapid entry of the water into this area can be provided to reduce outward loading on the coupling plate. However the seal may be located around the coupling plate or in other sealing areas between the cover assembly and the frame.

Preferably the hoop strength coupling plate is arranged to transfer hoop loads to the frame by studs connected between the hoop strength coupling plate and the frame. For example, the hoop strength coupling plate may have holes at side edges thereof arranged to engage studs on the frame. Alternatively he studs can be carried on the coupling plate and inserted into holes in the frame. In either case the use of studs allows simple connection in a single insertion action which is convenient for the user and inexpensive to manufacture.

Preferably the studs comprise shear bolts where an oversize hole in either the frame or the plate engages over a head of the shear bolt. This is a simple and convenient arrangement.

Preferably the cover plate is bolted to a front flange of the frame since this provides sufficient strength to accept the significant outward loads on the cover plate from the water pressing outwardly. However other fastening techniques can be used such as latches or hinges.

Preferably the liner retention system is fastened to the inside surface of the wall portion.

In this case, preferably the liner retention system includes a pair of parallel upright straps bolted to the panel on either side of the hole and a pair of parallel horizontal straps bolted to the panel above and below the hole.

Where the panels are corrugated with horizontally extending corrugations it is necessary that the upstanding straps are similarly corrugated.

However other fastening arrangements can be provided for example where the liner is fastened to the frame.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
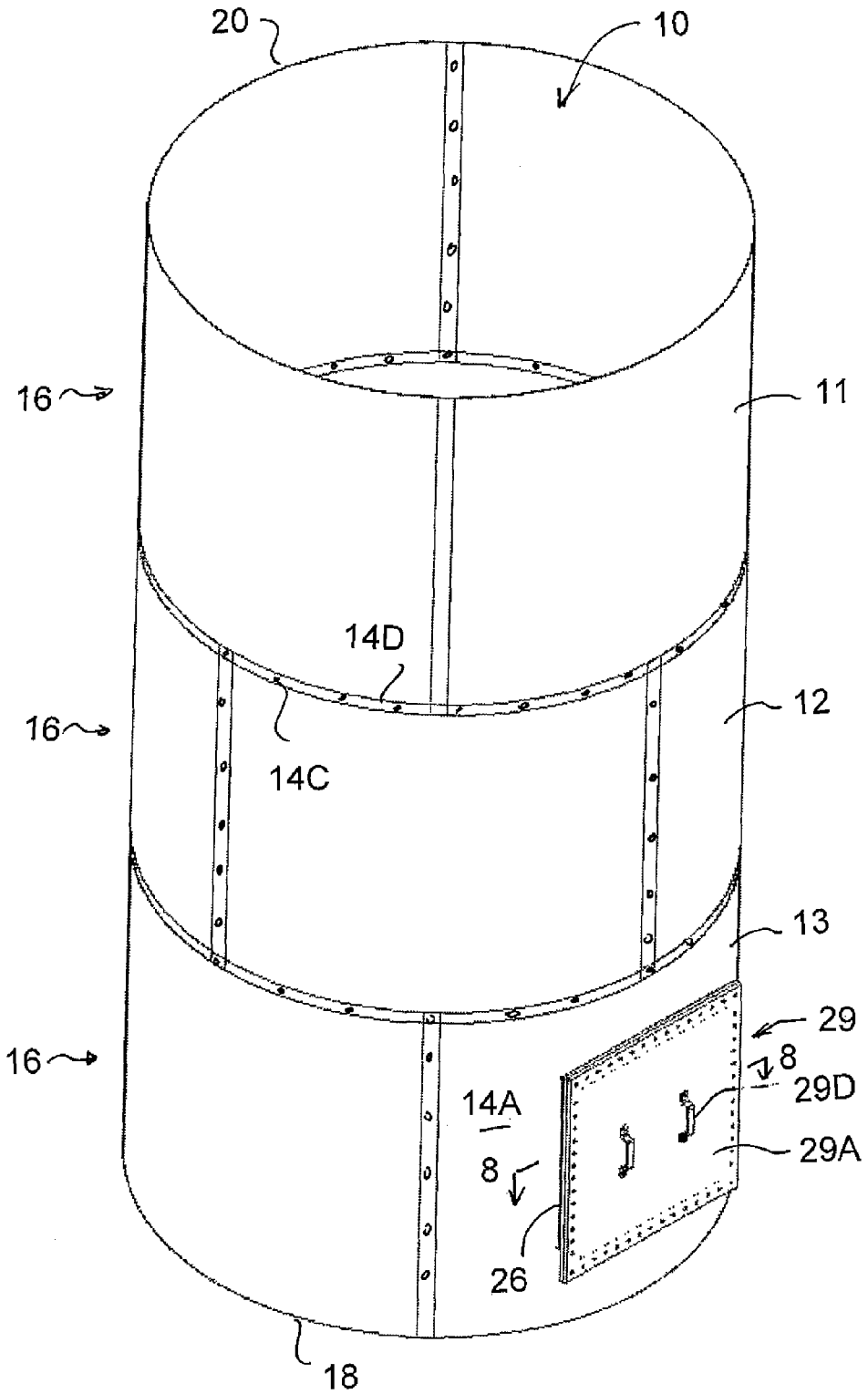
FIG. 1 is an isometric view of a tank according to the present invention showing the access opening on one panel of the bottom row of panels.
Figure 2:
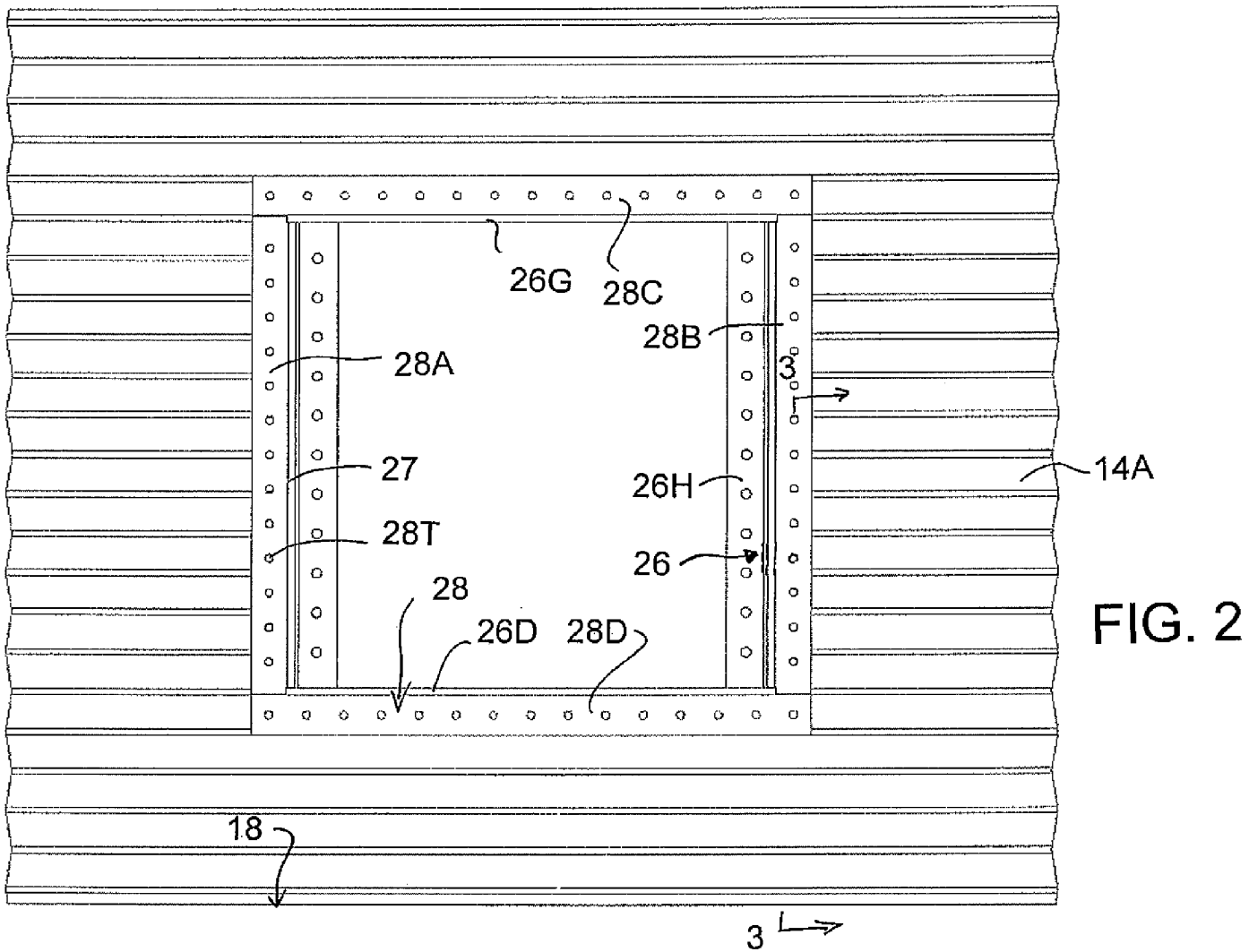
FIG. 2 is an isometric view of the tank of FIG. 1 showing the access opening from inside the tank.

The water tank 10 of the present embodiment is of the general type which includes a plurality of rows 11, 12, 13 of curved panels 14 where the panels 14 of each row are connected end edge to end edge to form a cylindrical wall portion 16 and where the wall portions formed by the rows are stacked and connected top edge to bottom edge to form a cylindrical wall 17 extending from a bottom edge 18 of the cylindrical wall mounted on a support surface 19 to a top edge 20 of the wall for containing water. The wall portions 14 are bolted together by bolts 14C at overlapping edge strips 14D. A liner 21 extends over the cylindrical wall 17 and support surface 19 to contain the water within the tank. The wall portions 14 are corrugated with horizontally extending corrugations 14B.

An access opening 25 is provided in the cylindrical wall 17 at one panel 14A. This includes a frame 26 welded into a hole 27 formed in the curved panel 14A.

Figure 3:
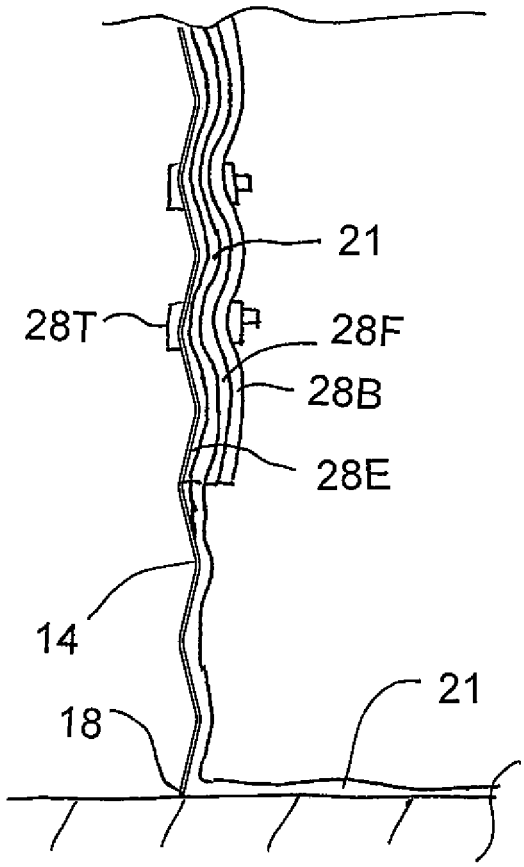
FIG. 3 is a vertical cross section along the lines 3-3 of FIG. 2 showing the connection of the liner to the wall surrounding the frame.

A liner retention system 28 surrounds the hole to fasten an edge 21A of the liner around the hole. The liner retention system includes a pair of parallel upright straps 28A, 28B bolted to the panel on either side of the hole 27 and a pair of parallel horizontal straps 28C, 28D bolted by bolts 28T to the panel above and below the hole with the liner retention system fastened to the inside surface of the wall portion. As shown in FIG. 3, the panel 14A is corrugated with horizontally extending corrugations 14B and the upstanding strap 28B is similarly corrugated. The straps 28A to 28B may be connected together to form a rectangular frame or the straps may be applied independently of one another. The straps clamp between them two layers of a sealing material 28E, 28F each on a respective side of the liner 21. The retention system 28 prevents the water from escaping into the area between the liner and the tank around the hole 27.

Figure 5:
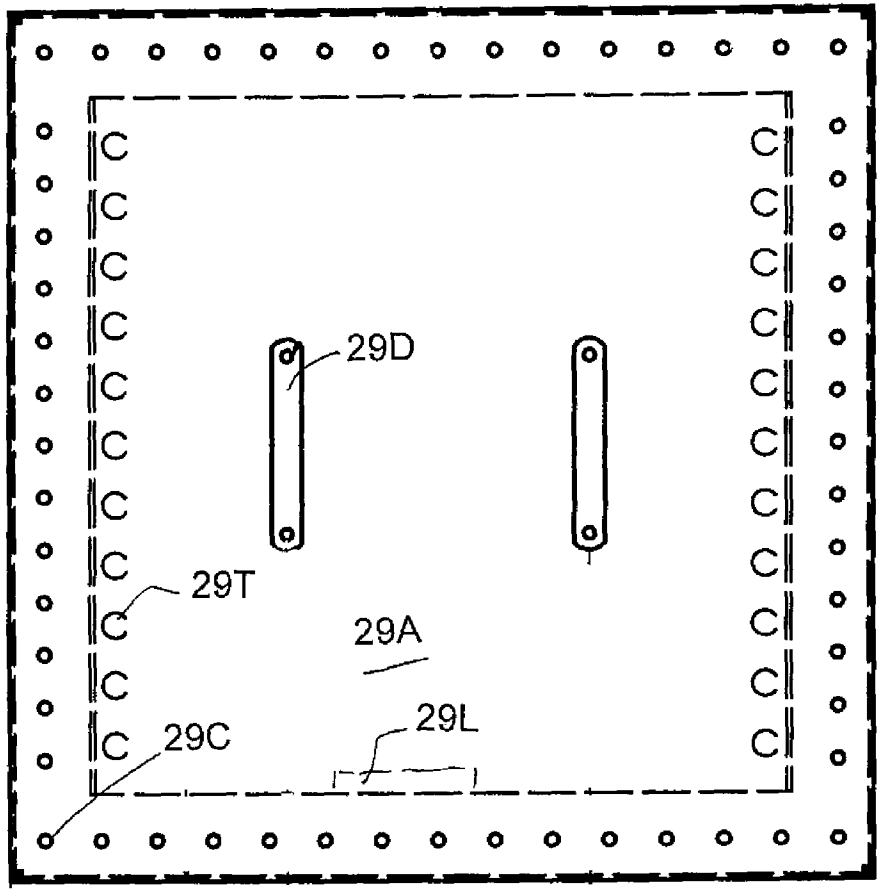
FIG. 5 is a front elevational view of the cover assembly of the tank of FIG. 1.
Figure 6:
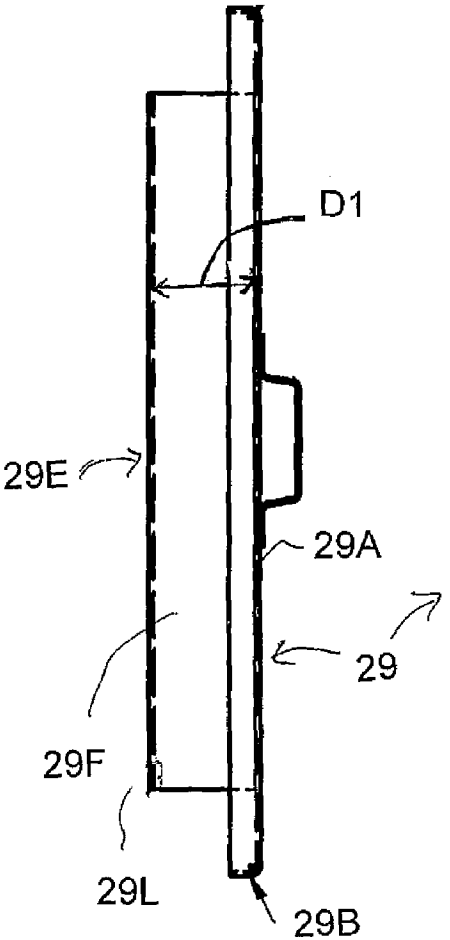
FIG. 6 is a side elevational view of the cover assembly of FIG. 5.

An access cover plate assembly 29 (FIGS. 5, 6) is fastened to the frame 26 (FIG. 4) so as to be removable therefrom to allow access to the interior of the tank inside the liner 21 by a person for service within the interior.

Figure 7:
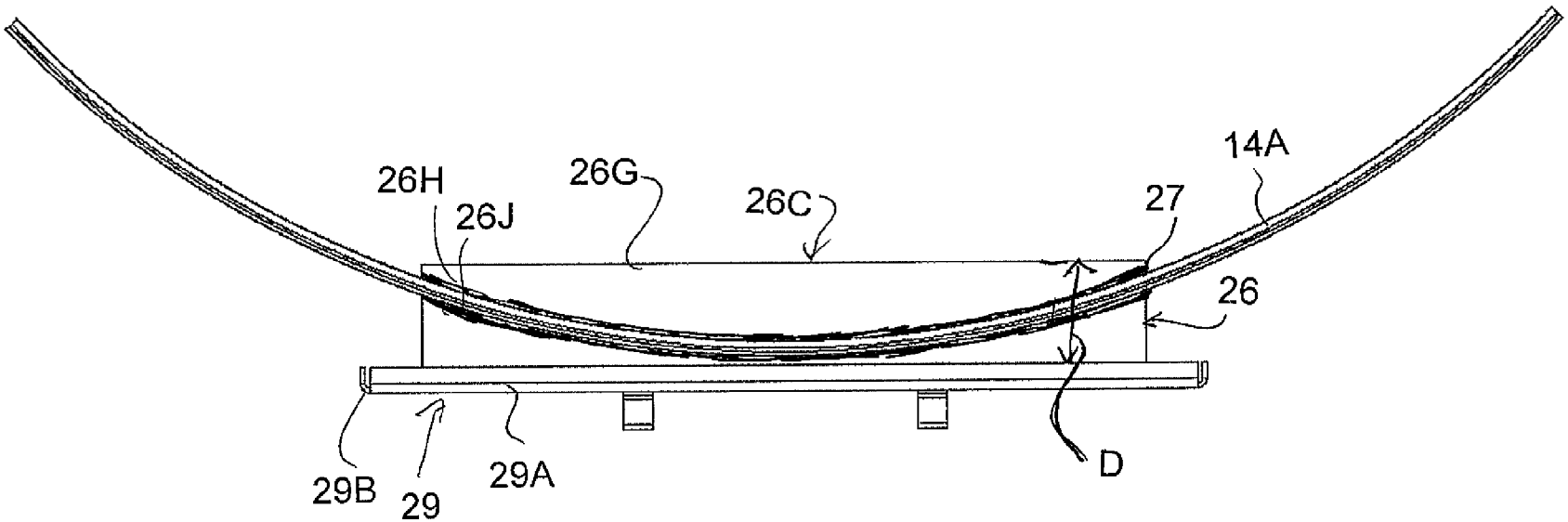
FIG. 7 is a top plan view of the frame and cover assembly of the access opening inserted into the wall portion of the tank of FIG. 1.
Figure 8:
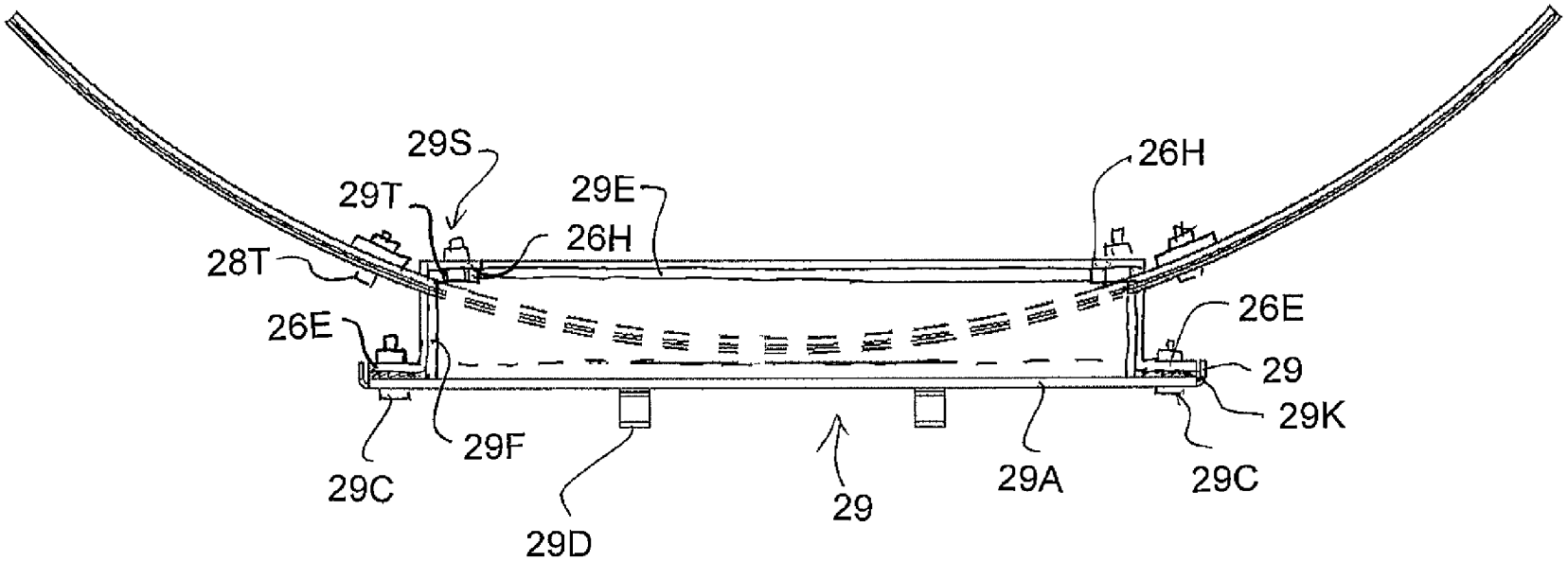
FIG. 8 is a cross sectional view along the lines 8-8 of FIG. 1 showing the cover assembly and frame of the tank.

The frame 26 is rectangular with two upstanding side posts 26A, 26B and two horizontal connecting rails 26C, 26D. The frame includes a front planar flange 26E, formed by a flange portion of each of the posts and rails, onto which the access cover plate assembly 29 is fastened. The frame further includes a rearwardly extending flange 26F, formed by a flange portion of each of the posts and rails. This flange 26F is welded to the panel 14A at an edge of the hole 27. The rearwardly extending flange portion 26G of each of the connecting rails 26C, 26D is deep enough in a direction D into the hole such that a horizontal curved edge of the panel 14A is welded onto the flange 26G, as shown in FIG. 7, across its full width while being spaced from the front flange 26E across its full width allowing the curved edge of the panel 14A to be as shown at weld beads 26H, 26J welded on the inside surface and on the outside surface of the wall portion 14A to the flange 26G.

Figure 4:
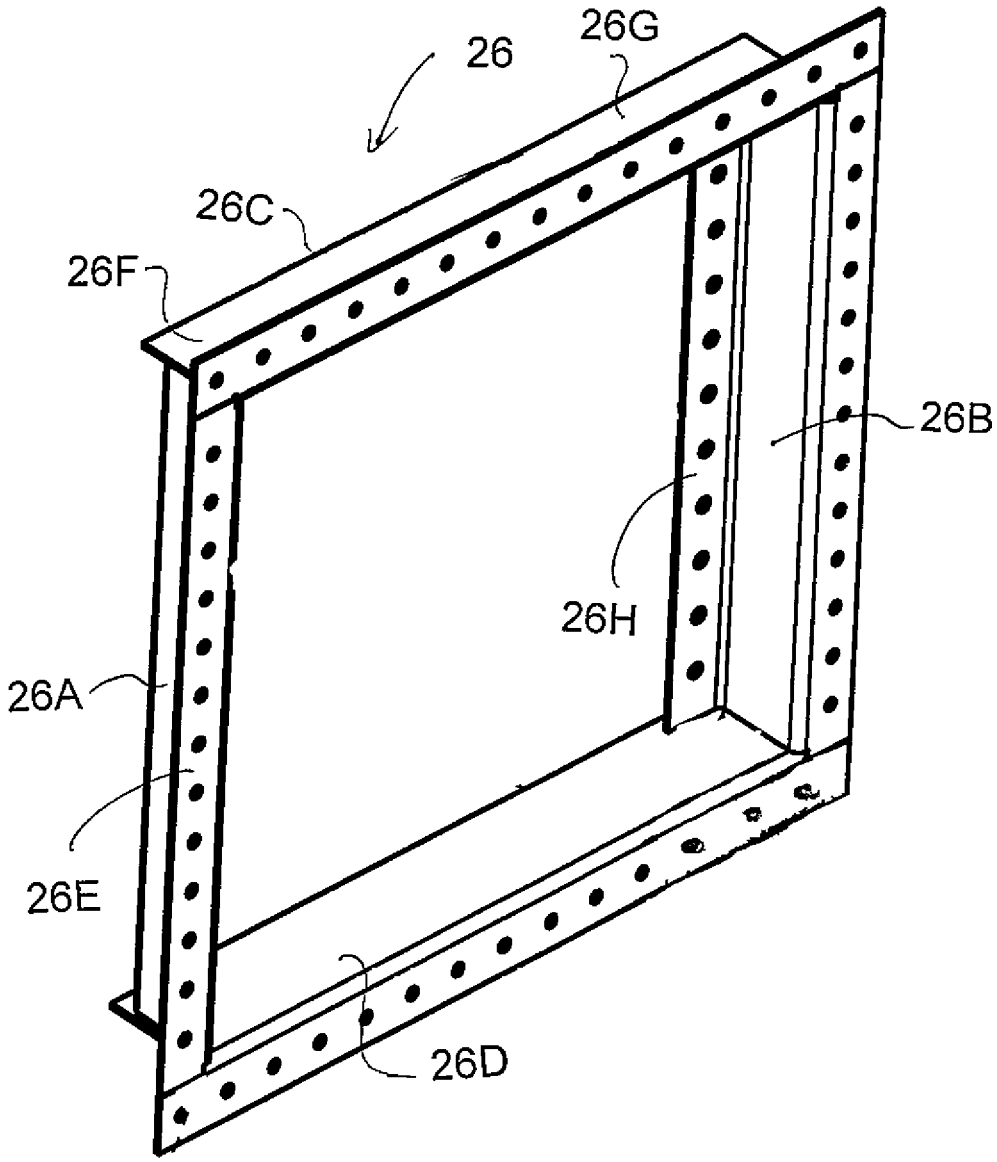
FIG. 4 is an isometric view of the frame only of the access opening for the tank of FIG. 1.

As best shown in FIG. 4, the rails 26C and 26D are L-shaped in cross-section to define the flanges 26E and 26F. The posts 26A and 26B are Z shaped in cross-section with the flange 26E at the front, the flange 26G extending rearwardly from an inner edge of the flange 26E and an additional flange 26H turned inwardly and welded on to the top surface of the flange 26G of the rail 26D and to the bottom surface of the flange 26G of the rail 26C. This fabricates the frame into a strong structure sufficient to take the loads from the water pressing outwardly and to transfer those loads into the wall panel 14A.

The cover plate assembly 29 includes a cover plate 29A with a peripheral strengthening flange 29B surrounding the outer edge of the flange 23E. The plate 29A is bolted to the flange 26E by a series of closely spaced bolts 29C in aligned holes in the plate and flange. A pair of lift handles 29D are located on the plate 29A. The assembly also includes a hoop strength coupling plate 29E extending across the hole 27 at the rear of the frame 26 for transferring hoop loads from the panel 14A across the frame and across the hole 27. The coupling plate 29E is attached to the rear of the plate 29A by two side flanges 29F which extend rearwardly from the plate to a distance D1 sufficient that the coupling plate sits against the flanges 26H when the rear face of the plate 29A sits on the flange 26E.

The rear flange 26H at each side of the frame 26 extends inwardly across the hole and the hoop strength coupling plate 29E is connected to each of the rear flanges for transferring the hoop loads therebetween. As the coupling plate is attached by welding to the cover plate 29A, the hoop strength coupling plate is removable with the cover plate. The cover plate is sealed to the frame by a sealing strip 29K between the flange 26E and the rear of the plate 29A to prevent escape of the water from the interior of the tank through the hole. The coupling plate is not sealed to the frame and a hole 29L so that water enters between the hoop strength coupling plate and the cover plate so that there is no pressure against the coupling plate. The coupling plate 29E is arranged to transfer hoop loads to the frame at the flanges 26H by studs 29S connected between the hoop strength coupling plate and the frame. These can be conveniently provided by oversize holes 29T at side edges of the plate 29E arranged to engage the studs 29S carried on the flanges 26H of the frame. The studs comprise shear bolts carried on the frame where the oversize hole in the coupling plate engages over a head of the shear bolt.

The cover plate assembly can thus be readily removed with the tank empty by releasing the bolts 29C and pulled away by the handles with the coupling plate simply pulling away from the studs on the frame with the cover assembly.

When attached, the hoop forces in the tank are transferred over the hole and through the frame by the plate 29E. The liner is effectively held in place by the peripheral retention straps holding it against the wall so that there are no penetrations in the wall at the frame to allow water to escape.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A water tank comprising:

a plurality of rows of curved panels of corrugated sheet metal with horizontally extending corrugations where the panels of each row are bolted end edge to end edge to form a cylindrical wall portion and where the wall portions formed by the rows are stacked and bolted top edge to bottom edge to form a cylindrical wall extending from a bottom edge of the cylindrical wall mounted on a support surface to a top edge of the wall for containing water;

a liner extending over the cylindrical wall and support surface to contain the water within the tank;

and an access opening in the cylindrical wall comprising:

a frame welded into a hole formed in one of the curved panels;

wherein the frame includes a front planar flange onto which the access cover plate is fastened and a rearwardly extending flange which is welded to the panel at an edge of the hole and wherein the rearwardly extending flange of each of the connecting rails is deep enough in a direction into the hole such that a horizontal curved edge of the panel is welded onto the flange across its full width while being spaced from the front flange across its full width;

wherein the curved edge of the corrugated panel is welded on the inside surface and on the outside surface to the rearwardly extending flange;

a liner retention system surrounding the hole to fasten an edge of the liner around the hole;

and an access cover plate arranged to be fastened to the frame so as to be removable therefrom to allow access to the interior of the tank inside the liner by a person for service within the interior.

2. The water tank according to claim 1 wherein the curved edge of the panel is welded on the inside surface and on the outside surface to the flange.

3. A water tank comprising:

a plurality of rows of curved panels where the panels of each row are connected end edge to end edge to form a cylindrical wall portion and where the wall portions formed by the rows are stacked and connected top edge to bottom edge to form a cylindrical wall extending from a bottom edge of the cylindrical wall mounted on a support surface to a top edge of the wall for containing water;

a liner extending over the cylindrical wall and support surface to contain the water within the tank;

and an access opening in the cylindrical wall comprising:

a frame welded into a hole formed in one of the curved panels;

a liner retention system surrounding the hole to fasten an edge of the liner around the hole;

and an access cover plate arranged to be fastened to the frame so as to be removable therefrom to allow access to the interior of the tank inside the liner by a person for service within the interior;

wherein there is provided a hoop strength coupling plate extending across the hole at the frame for transferring hoop loads from the panel across the frame, the hoop strength coupling plate being removable;

the hoop strength coupling plate being attached to the access cover plate to be removed therewith.

4. The water tank according to claim 3 wherein the frame includes a front flange onto which the access cover plate is fastened and a rearwardly extending flange which is welded to the panel at an edge of the hole.

5. A water tank comprising:

a plurality of rows of curved panels where the panels of each row are connected end edge to end edge to form a cylindrical wall portion and where the wall portions formed by the rows are stacked and connected top edge to bottom edge to form a cylindrical wall extending from a bottom edge of the cylindrical wall mounted on a support surface to a top edge of the wall for containing water;

a liner extending over the cylindrical wall and support surface to contain the water within the tank;

and an access opening in the cylindrical wall comprising:

a frame welded into a hole formed in one of the curved panels;

a liner retention system surrounding the hole to fasten an edge of the liner around the hole;

and an access cover plate arranged to be fastened to the frame so as to be removable therefrom to allow access to the interior of the tank inside the liner by a person for service within the interior;

wherein there is provided a hoop strength coupling plate extending across the hole at the frame for transferring hoop loads from the panel across the frame, the hoop strength coupling plate being removable;

and wherein the frame includes a front flange onto which the access cover plate is fastened and a rearwardly extending flange which is welded to the panel at an edge of the hole and wherein there is provided a rear flange at each side of the frame extending inwardly across the hole and wherein the hoop strength coupling plate is connected to each of the rear flanges for transferring the hoop loads therebetween.

6. The water tank according to claim 5 wherein the hoop strength coupling plate is removable with the cover plate.

7. The water tank according to claim 5 wherein the hoop strength coupling plate is carried on the cover plate for removal therewith.

8. The water tank according to claim 5 wherein the hoop strength coupling plate is arranged to transfer hoop loads to the frame by studs connected between the hoop strength coupling plate and the frame.

9. The water tank according to claim 8 wherein the hoop strength coupling plate has holes at side edges thereof arranged to engage studs on the frame.

10. The water tank according to claim 8 wherein the studs comprise shear bolts where a hole in either the frame or the plate engages over a head of the shear bolt.

11. A water tank comprising:

a plurality of rows of curved panels where the panels of each row are connected end edge to end edge to form a cylindrical wall portion and where the wall portions formed by the rows are stacked and connected top edge to bottom edge to form a cylindrical wall extending from a bottom edge of the cylindrical wall mounted on a support surface to a top edge of the wall for containing water;

a liner extending over the cylindrical wall and support surface to contain the water within the tank;

and an access opening in the cylindrical wall comprising:

a frame welded into a hole formed in one of the curved panels;

a liner retention system surrounding the hole to fasten an edge of the liner around the hole;

and an access cover plate arranged to be fastened to the frame so as to be removable therefrom to allow access to the interior of the tank inside the liner by a person for service within the interior;

wherein the cover plate is sealed to the frame by a sealing strip to prevent escape of the water from the interior of the tank through the hole;

wherein there is provided a hoop strength coupling plate extending across the hole at the frame for transferring hoop loads from the panel across the frame, the hoop strength coupling plate being removable;

and wherein the hoop strength coupling plate is not sealed to the frame so that water enters between the hoop strength coupling plate and the cover plate.

* * * * *